US009653855B2

(12) United States Patent
Kiryu et al.

(10) Patent No.: US 9,653,855 B2
(45) Date of Patent: May 16, 2017

(54) CONNECTOR AND CONNECTOR UNIT

(71) Applicants: FUJITSU COMPONENT LIMITED, Tokyo (JP); NTT FACILITIES, INC., Tokyo (JP)

(72) Inventors: Koichi Kiryu, Nagano (JP); Mitsuru Kobayashi, Tokyo (JP); Masatoshi Noritake, Tokyo (JP); Keiichi Hirose, Tokyo (JP)

(73) Assignees: FUJITSU COMPONENT LIMITED, Tokyo (JP); NTT FACILITIES, INC., Tokyo (JP)

( * ) Notice: Subject to any disclaimer, the term of this patent is extended or adjusted under 35 U.S.C. 154(b) by 0 days.

(21) Appl. No.: 15/107,159

(22) PCT Filed: Dec. 25, 2014

(86) PCT No.: PCT/JP2014/084318
§ 371 (c)(1),
(2) Date: Jun. 22, 2016

(87) PCT Pub. No.: WO2015/099044
PCT Pub. Date: Jul. 2, 2015

(65) Prior Publication Data

US 2017/0040753 A1 Feb. 9, 2017

(30) Foreign Application Priority Data

Dec. 27, 2013 (JP) ..... 2013-272955

(51) Int. Cl.
*H01R 29/00* (2006.01)
*H01R 13/703* (2006.01)
(Continued)

(52) U.S. Cl.
CPC ..... *H01R 13/7031* (2013.01); *H01H 9/0264* (2013.01); *H01R 24/78* (2013.01); *H01R 2103/00* (2013.01)

(58) Field of Classification Search
CPC ..... H01R 13/7036
(Continued)

(56) References Cited

U.S. PATENT DOCUMENTS

RE32,340 E * 1/1987 Dobson ..... H01R 13/453 200/50.28
5,095,182 A * 3/1992 Thompson ..... H01R 13/7036 200/43.04
(Continued)

FOREIGN PATENT DOCUMENTS

JP S57-161874 U 10/1982
JP H05-082208 4/1993
(Continued)

*Primary Examiner* — Neil Abrams
(74) *Attorney, Agent, or Firm* — IPUSA, PLLC

(57) ABSTRACT

A connector includes a fixed contact, a movable contact provided on one end of a movable plate, a connection terminal to be connected to another connection terminal of another connector, the connection terminal being connected to the fixed contact or the movable contact, a card provided in contact with the movable plate, a button provided in contact with the card, and a slide provided in contact with the button. With the connection terminal being in contact with the other connection terminal, the slide is contacted and pressed by a part of the other connector to slide to move the button, and the movable plate is moved by the movement of the button via the card so that the movable contact moves into contact with the fixed contact.

8 Claims, 22 Drawing Sheets

(51) Int. Cl.
*H01R 24/78* (2011.01)
*H01H 9/02* (2006.01)
*H01R 103/00* (2006.01)

(58) Field of Classification Search
USPC ..... 439/188; 200/51.09
See application file for complete search history.

(56) References Cited

U.S. PATENT DOCUMENTS

| | | | | |
|---|---|---|---|---|
| 7,445,472 | B1 * | 11/2008 | Huang | H01R 13/4536 439/138 |
| 7,982,144 | B2 * | 7/2011 | Kiryu | H01R 13/7038 200/51 R |
| 8,496,491 | B2 * | 7/2013 | Baek | H01R 13/71 200/51.09 |
| 8,692,634 | B2 * | 4/2014 | Yuba | H01H 15/02 200/51.09 |
| 8,841,572 | B2 * | 9/2014 | Iwamoto | H01H 1/26 200/430 |
| 9,225,125 | B2 * | 12/2015 | Iwamoto | H01R 13/70 |
| 9,281,635 | B2 * | 3/2016 | Beak | H01R 13/7132 |
| 2013/0231007 | A1 | 9/2013 | Iwamoto et al. | |

FOREIGN PATENT DOCUMENTS

| | | |
|---|---|---|
| JP | H11-233203 | 8/1999 |
| JP | 2003-031301 | 1/2003 |
| JP | 2012-064505 | 3/2012 |
| JP | 2012-104448 | 5/2012 |

* cited by examiner

CONNECTOR AND CONNECTOR UNIT

TECHNICAL FIELD

The present invention relates to connectors and connector units.

BACKGROUND ART

In general, electrical apparatuses operate with electric power supplied from a power supply or the like. When receiving electric power from a power supply, normally, electrical apparatuses are supplied with electric power from the power supply through a connector. As disclosed in Patent Documents 1 and 2, the connector employed establishes an electrical connection by mating a male connector having a protruding shape and a female connector having an indented shape.

On the other hand, in recent years, as a measure against global warming, supplying direct current, high-voltage electric power which is limited in power loss in voltage conversion or power transmission and does not require an increase in cable thickness has been studied in power transmission in local areas as well. Such form of power supply is considered desirable particularly for information apparatuses such as servers which consume a large amount of power.

Electric power supplied to electrical apparatuses may affect human bodies or the operations of electronic components if the voltage is high.

When using such high-voltage electric power for information apparatuses such as servers, connectors that establish electrical connection need to be different from those used for the common alternate-current commercial power supply, as the apparatuses are installed or maintained by human work.

PRIOR ART DOCUMENTS

[Patent Document 1] Japanese Laid-Open Patent Application No. 5-82208

[Patent Document 2] Japanese Laid-Open Patent Application No. 2003-31301

[Patent Document 3] Japanese Laid-Open Patent Application No. 2012-104448

SUMMARY OF THE INVENTION

Problems to be Solved by the Invention

Furthermore, in connectors that include a switch, currently-used switches are not directly usable when the voltage supplied from a power supply is higher than or equal to 100 V or is high voltage DC. For example, when the electric power supplied from a power supply is 400 V DC, it is dangerous to use switches currently used for 100 V AC as sufficient safety and reliability are not ensured.

Accordingly, the present invention has been made in view of the above, and has an object of providing a connector and a connector unit capable of safely supplying high-voltage electric power.

Means for Solving the Problems

According to an aspect of an embodiment, a connector includes a fixed contact, a movable contact provided on one end of a movable plate, a connection terminal to be connected to another connection terminal of another connector, the connection terminal being connected to the fixed contact or the movable contact, a card provided in contact with the movable plate, a button provided in contact with the card, and a slide provided in contact with the button. With the connection terminal being in contact with the other connection terminal, the slide is contacted and pressed by a part of the other connector to slide to move the button, and the movable plate is moved by the movement of the button via the card so that the movable contact moves into contact with the fixed contact.

Effects of the Invention

According to an aspect of the present invention, it is possible to provide a connector that supports a power supply whose voltage is higher than the voltage of the current commercial power supply or supports a DC power supply and is capable of safely supplying electric power from these power supplies, and to provide a connector unit.

EMBODIMENTS OF THE INVENTION

Figure 1:
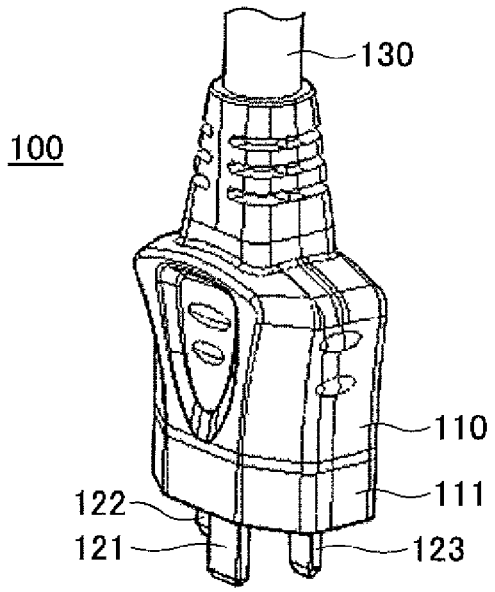
FIG. 1 is a perspective view of a plug connector used in an embodiment.

An embodiment of the present invention is described below with reference to the accompanying drawings. The same members or the like are referred to using the same reference numeral, and a repetitive description thereof is omitted.

A structure of a connector according to this embodiment is described. The connector according to this embodiment is connected to a plug connector that is another connector depicted in FIG. 1, and corresponds to a jack connector of a structure depicted in FIG. 2. The plug connector is provided with plug terminals that serve as other connection terminals. The jack connector is provided with jack terminals that connect to the other connection terminals.

Figure 2:
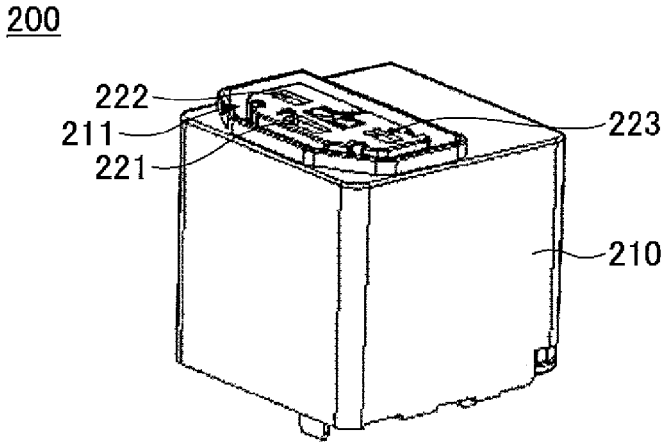
FIG. 2 is a perspective view of a jack connector according to the embodiment.

In this embodiment, a plug connector 100 depicted in FIG. 1 and a connector corresponding to a jack connector 200 depicted in FIG. 2 may be collectively referred to as "connector unit."

First, the plug connector 100 used in this embodiment is described with reference to FIG. 1. FIG. 1 is a perspective view of the plug connector 100. Plug terminals 121, 122 and 123 to be inserted into the below-described jack connector 200 are provided in a plug housing 110 of the plug connector 100 to project from a first end of the plug housing 110. A power supply cable 130 for supplying electric power is connected to a second end of the plug housing 110 opposite to the first end. The plug connector 100 includes an edge 111 that surrounds the plug terminals 121, 122 and 123. The plug terminal 121 is a ground (GND) terminal and is longer than the plug terminals 122 and 123. The plug housing 110 is formed of an insulating material such as a resin. The edge 111 is formed as part of the plug housing 110.

Figure 3:
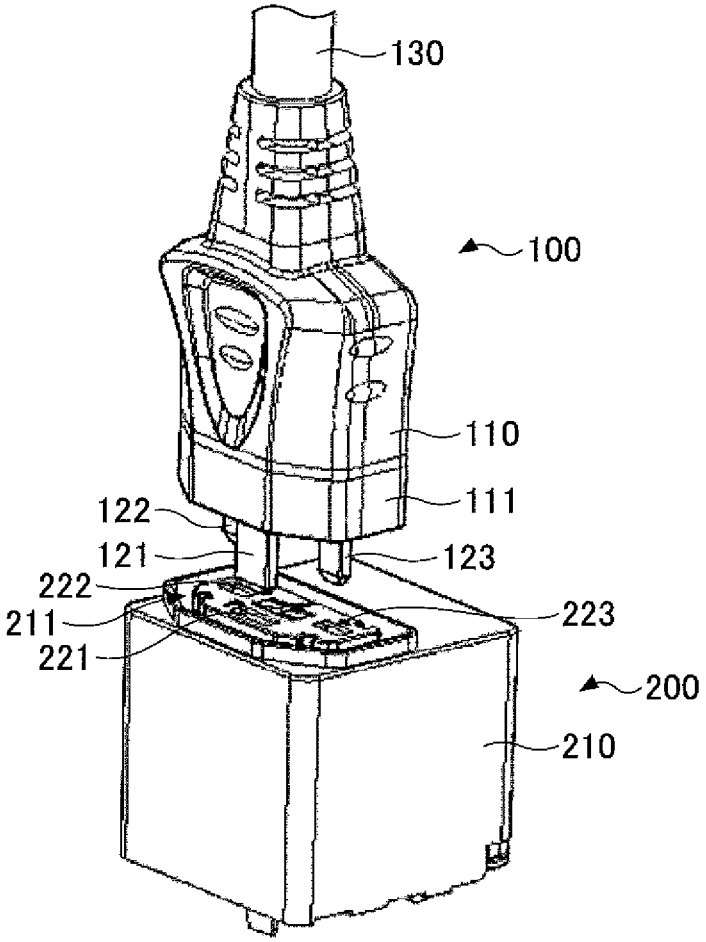
FIG. 3 is a perspective view of the plug connector and the jack connector before being connected.
Figure 4:
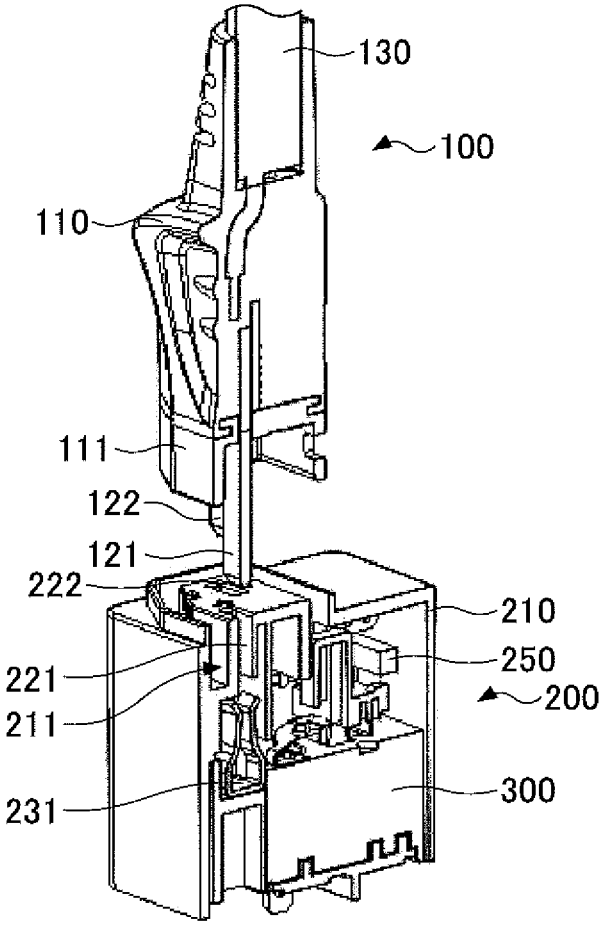
FIG. 4 is a cross-sectional view of the plug connector and the jack connector before being connected.
Figure 5:
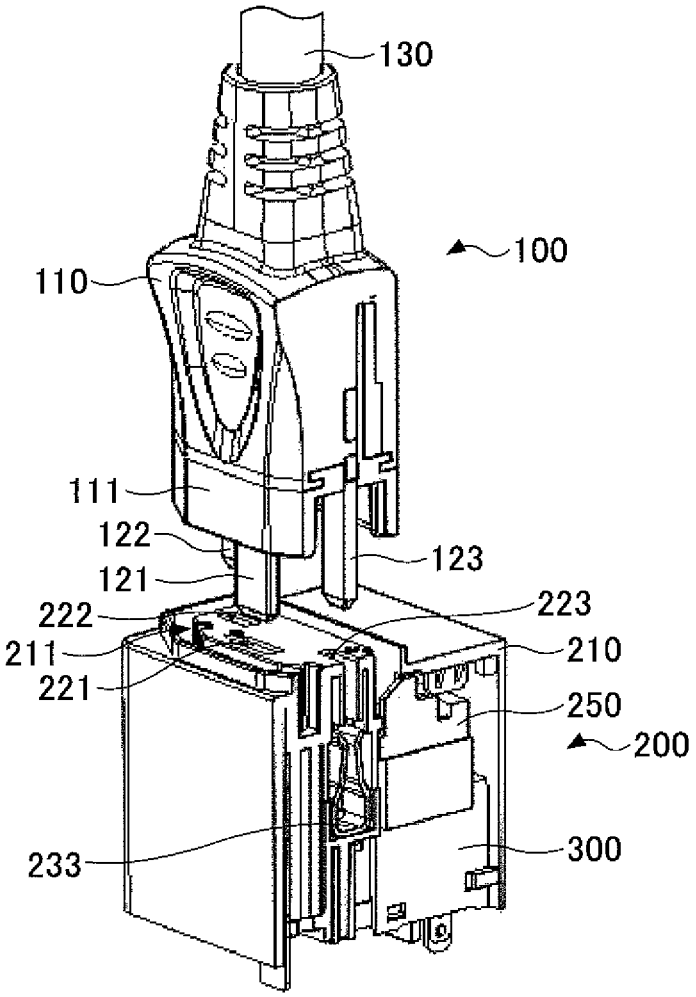
FIG. 5 is another cross-sectional view of the plug connector and the jack connector before being connected.
Figure 6:
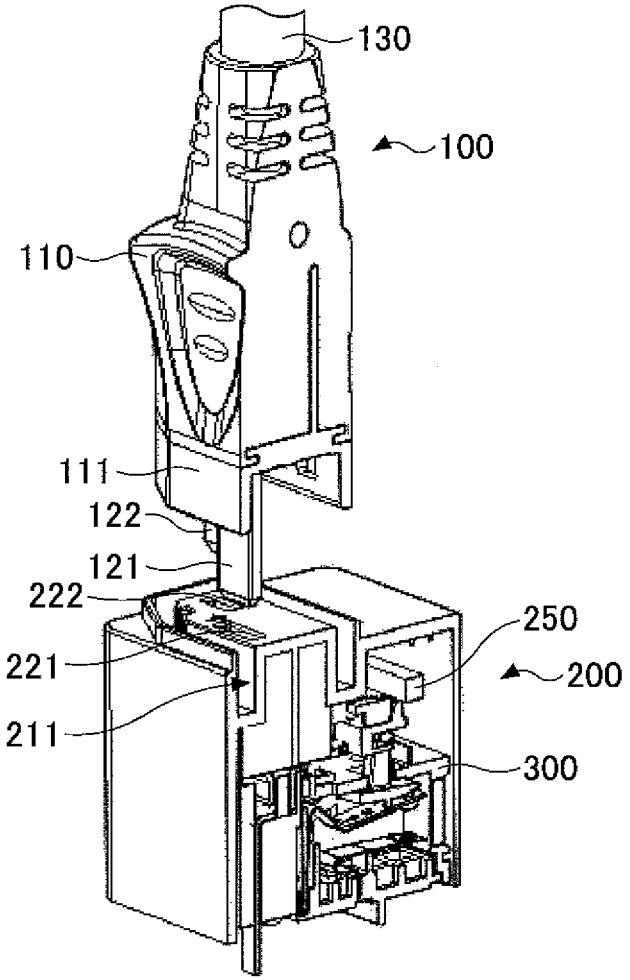
FIG. 6 is yet another cross-sectional view of the plug connector and the jack connector before being connected.
Figure 7:
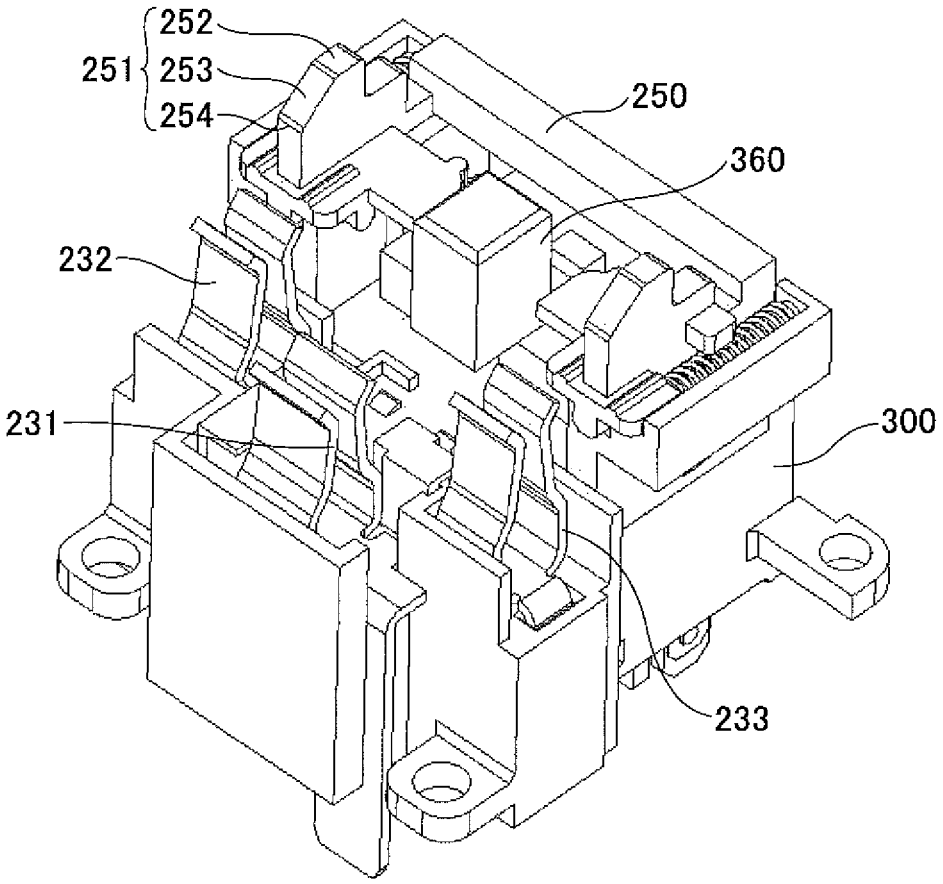
FIG. 7 is a perspective view of an internal structure of the jack connector according to the embodiment.

Next, the jack connector 200 according to this embodiment is described with reference to FIGS. 2, 3, 4, 5, 6 and 7. FIG. 2 is a perspective view of the jack connector 200. FIG. 3 is a perspective view of the plug connector 100 and the jack connector 200 before being mated. FIGS. 4 through 6 are perspective cross-sectional views of the plug connector 100 and the jack connector 200 before being mated, depicting different cross sections. FIG. 7 is a perspective view of an internal structure of the jack connector 200.

The jack connector 200 includes a jack housing 210. The jack housing 210 is provided with jack openings 221, 222 and 223. As depicted in, for example, FIG. 7, jack terminals 231, 232 and 233 to be connected to the plug terminals 121, 122 and 123 of the plug connector 100 are provided in the jack openings 221, 222 and 223, respectively, in the jack connector 200.

Accordingly, the plug terminal 121 of the plug connector 100 is connected to the jack terminal 231 provided in the jack opening 221 of the jack connector 200, the plug terminal 122 of the plug connector 100 is connected to the jack terminal 232 provided in the jack opening 222 of the jack connector 200, and the plug terminal 123 of the plug connector 100 is connected to the jack terminal 233 provided in the jack opening 223 of the jack connector 200. Furthermore, a groove 211 that receives the edge 111 of the plug connector 100 is formed around the jack openings 221, 222 and 223. The jack terminal 231 provided in the jack opening 221 of the jack connector 200 is a GND terminal.

Furthermore, the jack connector 200 includes a below-described switch part 300 depicted in FIGS. 8 and 9 inside the jack housing 210. The switch part 300 is provided with a metal terminal corresponding to the jack terminal 232, a metal terminal corresponding to the jack terminal 233, and a metal terminal corresponding to the jack terminal 231 of the jack connector 200. Electric power is supplied by the metal terminal corresponding to the jack terminal 232 and the metal terminal corresponding to the jack terminal 233. The contacts of a switch of the switch part 300 are closed to electrically connect the jack terminals 232 and 233 and the corresponding metal terminals to supply electric power. Furthermore, the switch of the switch part 300 is opened to electrically disconnect the jack terminals 232 and 233 and the corresponding metal terminals to stop the supply of electric power.

Figure 8:
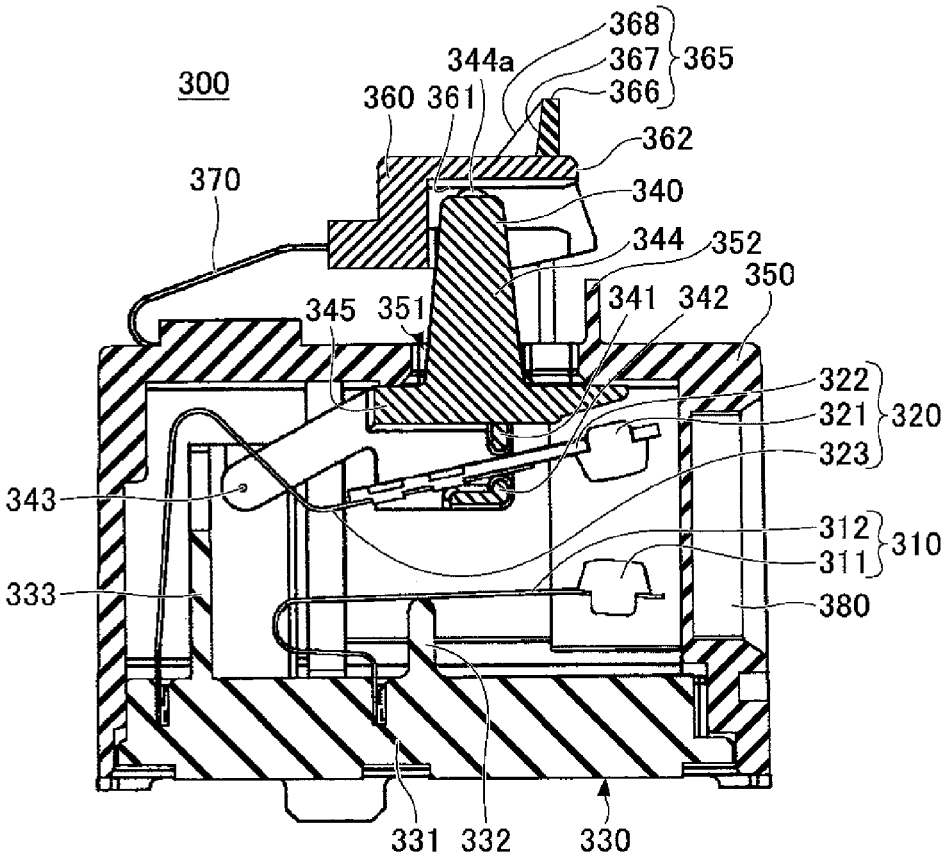
FIG. 8 is a structural diagram of a switch part (OFF state).
Figure 9:
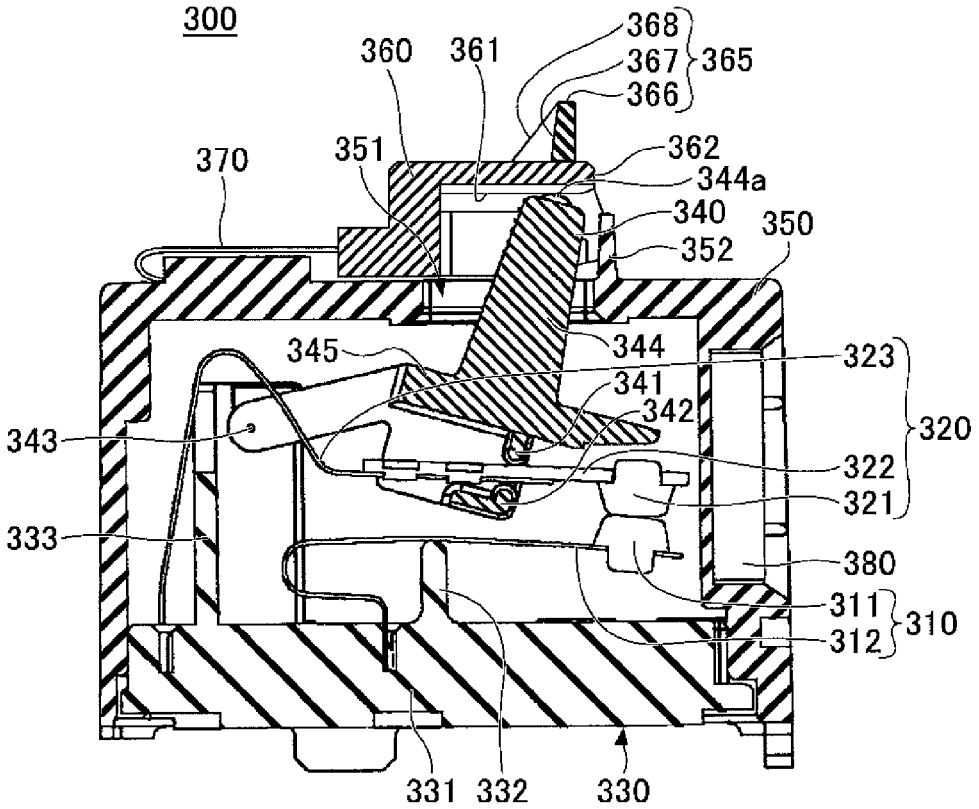
FIG. 9 is a structural diagram of the switch part (ON state).

According to this embodiment, a button 360 of the switch part 300 depicted in FIGS. 7 through 9 is depressed to close the switch of the switch part 300 to supply electric power. At this point, a slide 250 provided inside the jack connector 200 slides, so that the button 360 is pressed downward by the slide 250. As a result, the switch of the switch part 300 is closed, so that electric power is supplied to the plug connector 100 through the jack terminals 232 and 233. In the state depicted in FIGS. 4 through 6, the slide 250 is positioned on the side of the groove 211.

Next, the switch part 300 provided in the jack connector 200 is described with reference to FIGS. 8 and 9. FIG. 8 is a cross-sectional view of the switch part 300 when the switch part 300 is in OFF state. FIG. 9 is a cross-sectional view of the switch part 300 when the switch part 300 is in ON state. According to this embodiment, the switch part 300 is a switch for controlling an electric power supply, and is also referred to as "power switch." The switch part 300 includes two pairs of a fixed part 310 and a movable part 320, one provided for each of the jack terminals 232 and 233.

As depicted in FIGS. 8 and 9, the switch part 300 includes the fixed parts 310 and the movable parts 320, and performs on-off control of an electric power supply based on the presence or absence of the contact of fixed contacts 311 of the fixed parts 310 and movable contacts 321 of the movable parts 320.

Each fixed part 310 in its entirety is formed of a conductive material such as a metal, and includes the fixed contact 311 and a fixed spring 312. The fixed contact 311 that contacts the corresponding movable contact 321 is provided on one end of the fixed spring 312. The fixed spring 312 is formed by bending a metal plate or the like formed of copper, an alloy including copper, or the like. The fixed contact 311 is formed of an alloy of silver and copper. Another end of the fixed spring 312 is fixed to a base block body 331 of a base block 330. An intermediate portion of the fixed spring 312 is supported by and fixed to a fixed part support 332.

Each movable part 320 in its entirety is formed of a conductive material such as a metal, and includes the movable contact 321, a movable plate 322, and a movable spring 323. The movable contact 321 that contacts the corresponding fixed contact 311 is provided on one end of the movable plate 322. Another end of the movable plate 322 and one end of the movable spring 323 are connected. Each of the movable plate 322 and the movable spring 323 is formed by bending a metal plate or the like formed of copper, an alloy including copper, or the like. The movable contact 321 is formed of an alloy of silver and copper. Another end of the movable spring 323 is fixed to the base block body 331 of the base block 330. The movable spring 323 is formed by bending a metal plate or the like. Therefore, the movable spring 323 is flexible to allow the movable contact 321 provided on the one end of the movable plate 322 to move upward and downward. Furthermore, an insulation wall 333 formed of a flame-retardant resin or the like is provided on the base block 330 between a part to which the other end of the fixed spring 312 is connected and a part to which the other end of the movable spring 323 is connected. The movable spring 323 extending from the other end is bent to go around part of the insulation wall 333.

An upper surface of the movable part 320 which serves as one surface of the movable plate 322 is in contact with an upper contact 341 which serves as a first contact of a card 340. A lower surface of the movable part 320 which serves as another surface of the movable plate 322 is in contact with a lower contact 342 which serves as a second contact of the card 340. By rotating the card 340 about a rotation shaft 343 in this state, a force is applied to the movable plate 322 with the movable plate 322 being in contact with the upper contact 341 or the lower contact 342, so that the movable contact 321 can move upward or downward. The upper contact 341 and the lower contact 342 slide on the movable plate 322. Therefore, to reduce frictional resistance, a surface layer formed of fluororesin or the like may be provided on a surface of the upper contact 341 and a surface of the lower contact 342.

The fixed parts 310 and the movable parts 320 are provided inside a region surrounded by the base block 330 and a switch part case 350. The card 340 includes a projection 344 and a card body 345. The projection 344 is shaped to project outward from a switch part opening 351 provided in the switch part case 350. The card body 345 is positioned inside the region surrounded by the base block 330 and the switch part case 350. Accordingly, in the switch part 300, the upper contact 341 and the lower contact 342 are provided inside the region surrounded by the base block 330 and the switch part case 350. The card 340, the base block 330, and the switch part case 350 are formed of an insulating material such as a resin.

The button 360 that is depressed to rotate the card 340 about the rotation shaft 343 is provided outside the switch part case 350. The card 340 is in contact with an inner wall 361 of the button 360 at a contact 344*a* provided on top of the projection 344 of the card 340. The contact 344*a* slides on a surface of the inner wall 361. Therefore, a surface layer formed of fluororesin or the like may be provided on the surface of the inner wall 361 to reduce frictional resistance. An opening spring 370 having one end connected to the switch part case 350 and another end connected to the button 360 is provided outside the switch part case 350.

Figure 10:
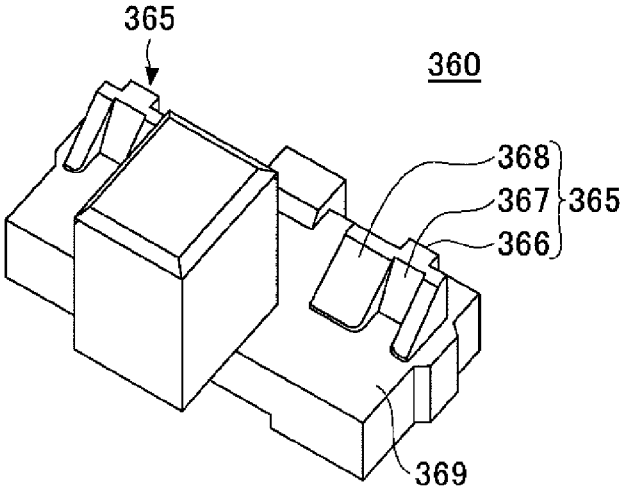
FIG. 10 is a perspective view of a button of the switch part.

FIG. 10 is a perspective view of the button 360. Referring also to FIG. 10, according to this embodiment, the button 360 includes a lower flat part 369 and button projections 365 that project upward from the lower flat part 369. Each button projection 365 includes an upper flat part 366 that is an upper part of the button projection 365 that is formed to be flat. A side surface of the button projection 365 that extends from the upper flat part 366 toward the lower flat part 369 includes a steep slope 367 that is steeply inclined and a moderate slope 368 that is moderately inclined.

Figure 11:
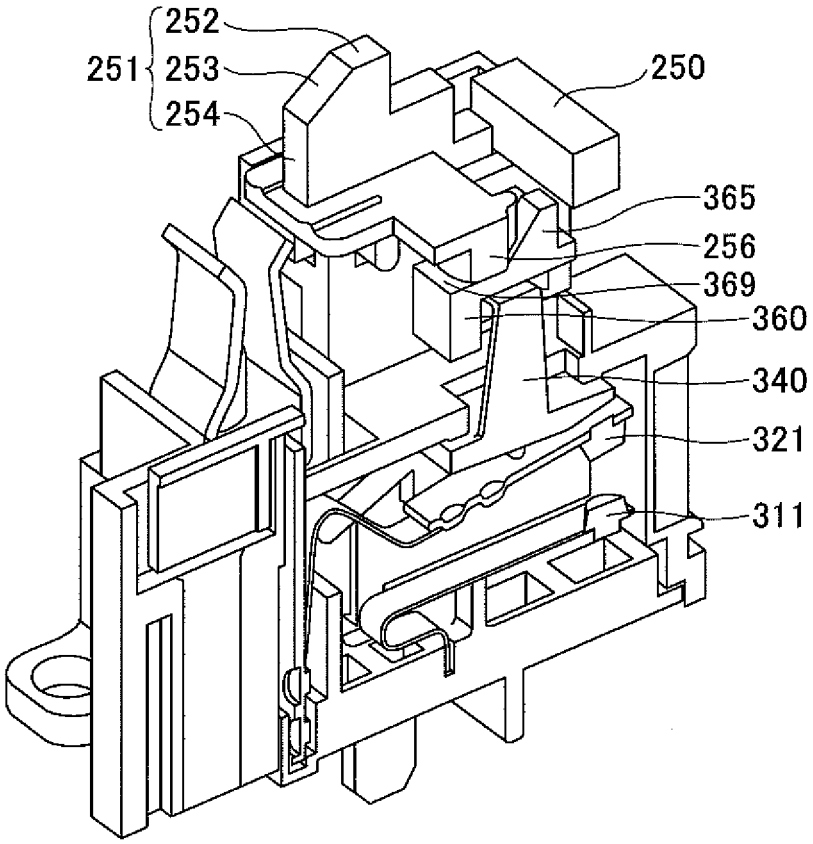
FIG. 11 is a perspective cross-sectional view of an internal structure of the jack connector according to the embodiment.
Figure 12:
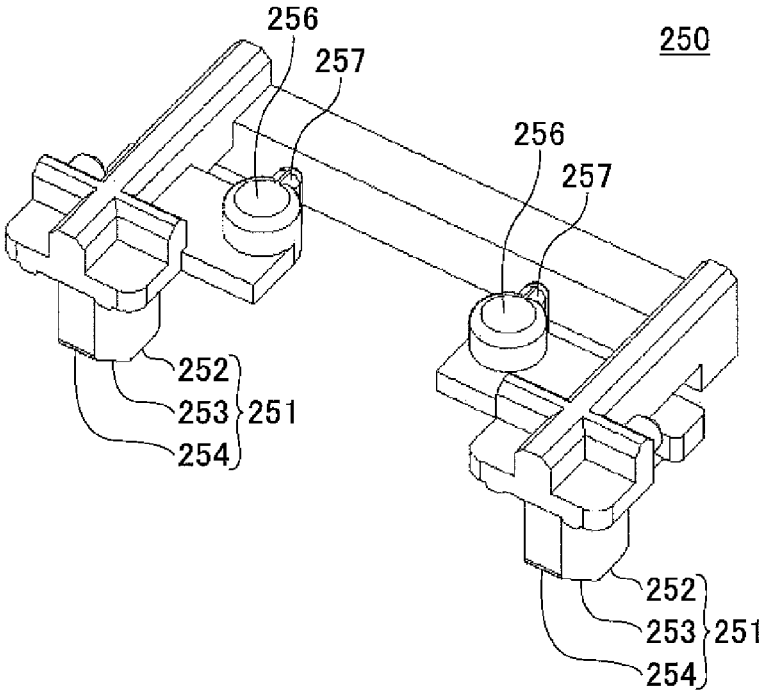
FIG. 12 is a perspective view of a slide.
Figure 13:
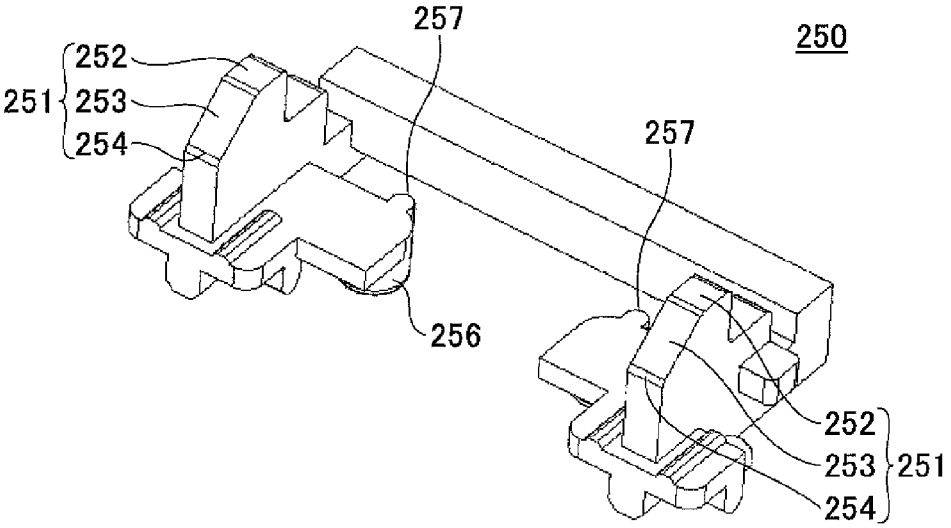
FIG. 13 is another perspective view of the slide.

Next, the slide 250 is described with reference to FIGS. 7, 11, 12 and 13. FIG. 11 is a perspective cross-sectional view of an internal structure of the jack connector 200. FIGS. 12 and 13 are perspective views of the slide 250.

According to this embodiment, the slide 250 provided inside the jack connector 200 is slid by the insertion of the plug connector 100 to press the button 360 to turn ON the switch part 300.

Upper projections 251 are formed on one surface (an upper surface in FIG. 7 and a surface depicted in FIG. 13) of the slide 250. Each upper projection 251 includes a flat upper surface 252 and a slide slope 253. The upper surface 252 is formed at an upper end of the upper projection 251. The slide slope 253 extends at an angle in a downward direction from an end of the upper surface 252 to a lower-end slope end 254. Furthermore, lower projections 256 are formed on another surface (a surface depicted in FIG. 12) of the slide 250. As depicted in FIG. 12, each lower projection 256 is substantially circularly formed, and a protrusion 257 protrudes from each lower projection 256. Each lower projection 256 and protrusion 257 are formed so that their respective ends (upper ends in FIG. 12) are at the same level.

According to this embodiment, when the plug connector 100 is inserted into the jack connector 200 in the state depicted in FIGS. 7 and 11, the edge 111 of the plug connector 100 contacts the slide slopes 253 of the upper projections 251 of the slide 250, so that the slide slopes 253 are pushed. As a result, the slide 250 slides in a direction away from the jack terminals 231 through 233. After the slide 250 slides until the edge 111 and the slope ends 254 of the slide 250 contact, the slide 250 stops sliding. The slide 250 slides to depress the button 360, so that the card 340 rotates downward. Thereafter, the edge 111 of the plug connector 100 along with the plug terminals 121, 122 and 123 moves further into the jack connector 200, so that the switch of the switch part 300 is turned on to supply electric power to the plug connector 100.

When turning on the switch of the switch part 300, the plug connector 100 is inserted into the jack connector 200. As a result, the button 360 is pressed, so that the card 340 having the contact 344*a* contacting the inner wall 361 of the button 360 rotates about the rotation shaft 343 to apply a downward force to the movable plates 322 of the movable parts 320 through the upper contact 341. As a result, the movable contacts 321 and the fixed contacts 311 come into contact as depicted in FIG. 9, and the movable contacts 321 and the fixed contacts 311 are kept in contact to supply electric power from the power supply to the plug connector 100.

When turning off the switch of the switch part 300, as described below, a force pressing the button 360 is lost by removing the plug connector 100 from the jack connector 200, so that the button 360 returns to OFF state by a restoring force due to the elasticity of the opening spring 370 and the elasticity of the movable springs 323. That is, when the button 360 moves upward as depicted in FIG. 8 from the state of FIG. 9, the card 340 having the contact 344*a* contacting the inner wall 361 of the button 360 rotates about the rotation shaft 343 to apply an upward force to the movable plates 322 of the movable parts 320 through the lower contact 342. It is possible to bring the movable contacts 321 and the fixed contacts 311 out of contact, and accordingly to stop the supply of electric power from the power supply, with the upward force thus applied to the movable plates 322. At this point, arcs may be generated between the movable contacts 321 and the fixed contacts 311. Accordingly, a permanent magnet 380 generating a magnetic field in a direction substantially perpendicular to directions in which arcs are generated is provided near the contact positions of the movable contacts 321 and the fixed contacts 311 so as to be able to blow off the arcs by the force of the magnetic field. When the button 360 is returned to the original state, that is, when the button 360 is lifted up by the restoring force of the opening spring 370, the card 340 also is lifted up in conjunction with the button 360 and the movable contacts 321 are separated from the fixed contacts 311. When the card 340 is lifted up in conjunction with the button 360, the card 340 may be lifted up by the restoring force of the movable springs 323.

As described above, the insulation wall 333 is provided in the switch part 300, on the base block 330 between a part to which the other end of each fixed spring 312 is connected and a part to which the other end of each movable spring 323 is connected. As a result, the fixed parts 310 and the movable parts 320 are separated by the insulation wall 333. Therefore, even if the melting or the like of the fixed parts 310 or the movable parts 320 due to heat progresses, it is possible to prevent the fixed parts 310 and the movable parts 320 from sticking together because of the melting to cause an electric current to continue to flow.

In the switch part 300, if dirt or the like enters the region surrounded by the base block 330 and the switch part case 350, a short-circuit or contact failure may occur between the fixed contacts 311 and the movable contacts 321. Accordingly, when the switch part 300 is in OFF state, an upper surface of the card body 345 of the card 340 contacts and is pressed against the switch part case 350 to close the switch part opening 351 to prevent an entry of dirt or the like into the region surrounded by the base block 330 and the switch part case 350. As a result, an entry of dust or the like into the switch part case 350 through the switch part opening 351 when the switch part 300 is in OFF state can be prevented.

Furthermore, to prevent an entry of dust or the like into the region surrounded by the base block 330 and the switch part case 350 when the switch part 300 is in ON state, a wall 352 is formed on the switch part case 350 near the switch part opening 351, and the button 360 includes an angular U-shaped end 362. When the switch part 300 is in ON state, the angular U-shaped end 362 of the button 360 covers the wall 352 on the switch part case 350, so that the wall 352 and the end 362 close the opening between the wall 352 and the end 362 that is present in OFF state. As a result, it is possible to prevent an entry of dust or the like into the switch part case 350 through the switch part opening 351 when the switch part 300 is in ON state.

Next, a method of connecting connectors according to this embodiment is described. Specifically, the transition from the state where the plug connector 100 and the jack connector 200 are separated as depicted in FIGS. 3 through 6 to the state where the plug connector 100 and the jack connector 200 are mated to be electrically connected is described in sequence. In the following, the connection of the plug terminal 121 and the jack terminal 231 and the connection of the plug terminal 123 and the jack terminal 233 are described. The same is the case with the connection of the plug terminal 122 and the jack terminal 232.

Figure 14:
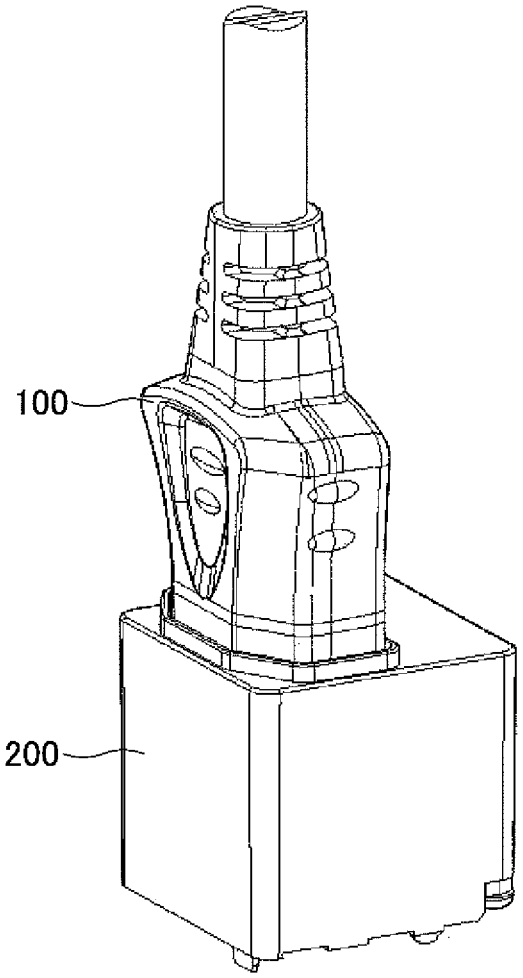
FIG. 14 is a perspective view of the plug connector and the jack connector in the process of being connected.
Figure 15:
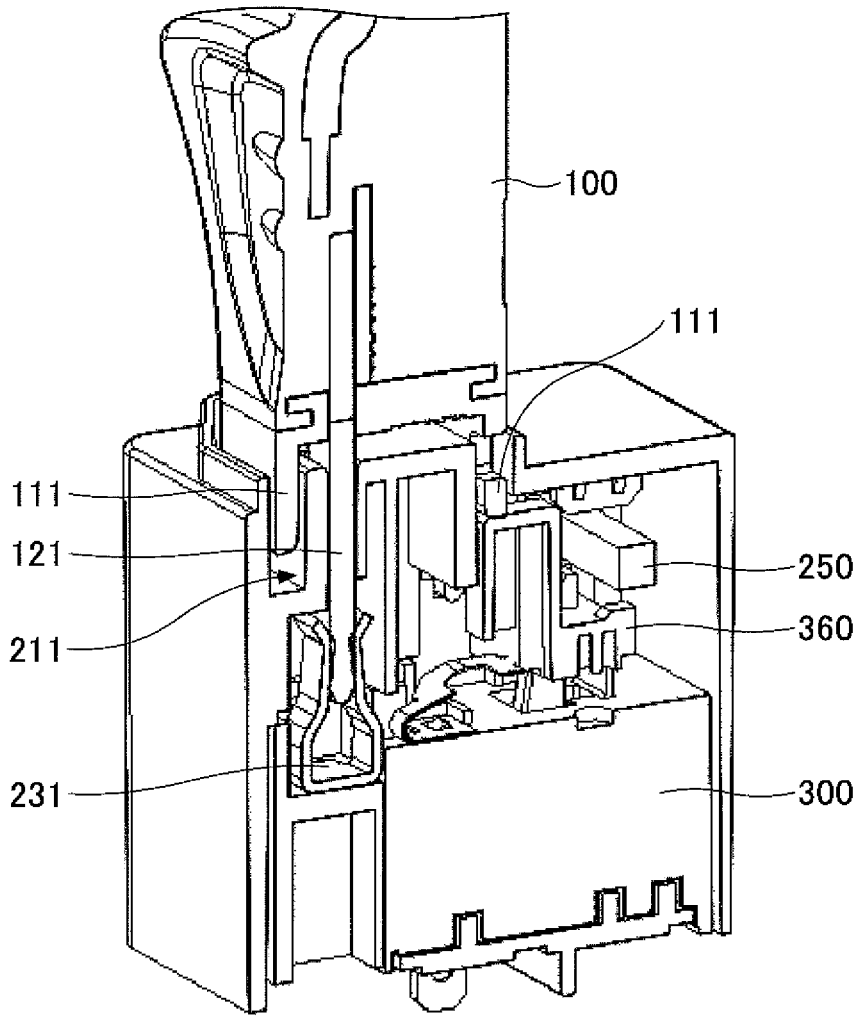
FIG. 15 is a cross-sectional view of the plug connector and the jack connector in the process of being connected.
Figure 16:
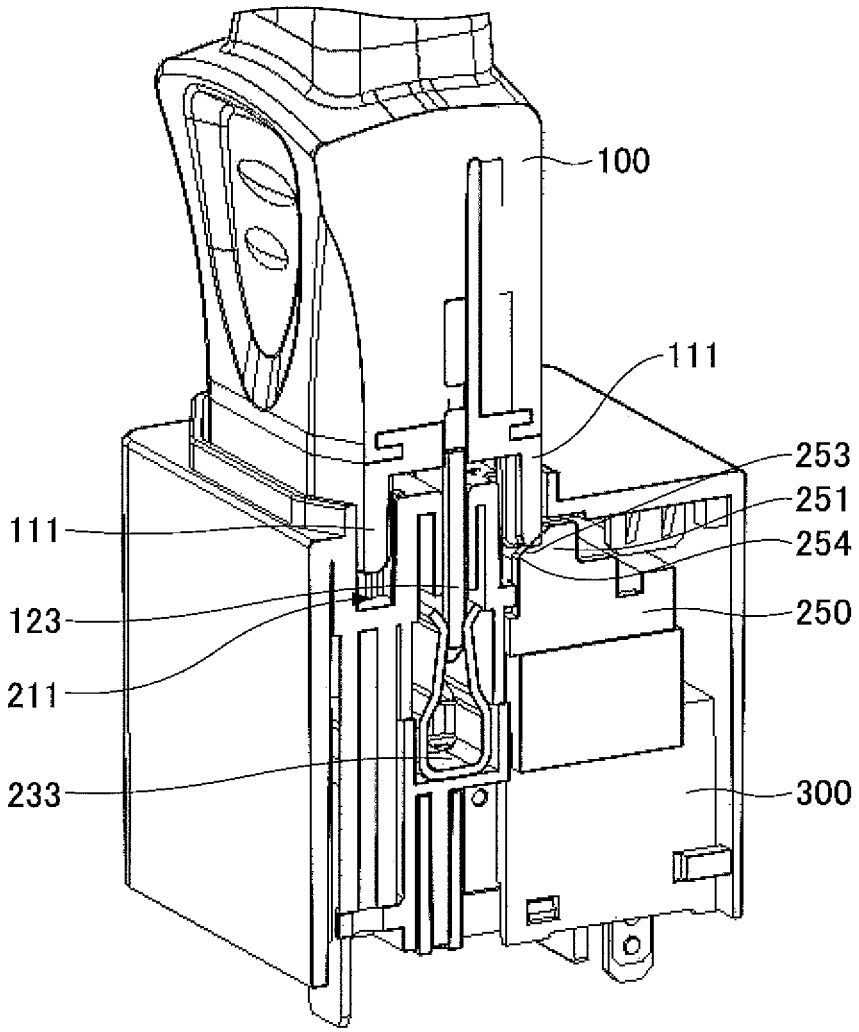
FIG. 16 is another cross-sectional view of the plug connector and the jack connector in the process of being connected.
Figure 17:
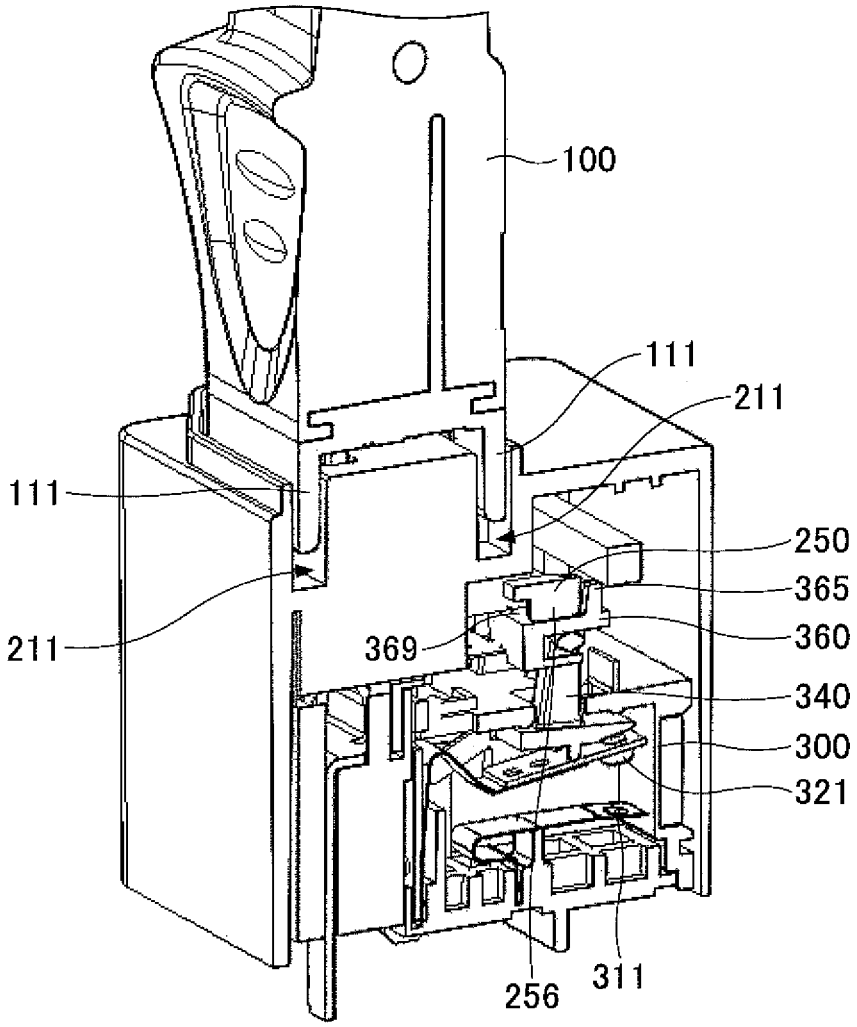
FIG. 17 is yet another cross-sectional view of the plug connector and the jack connector in the process of being connected.

First, the plug terminals 121, 122 and 123 of the plug connector 100 are inserted into the jack openings 221, 222 and 223 of the jack connector 200, respectively, from the state depicted in FIGS. 3 through 6, and the plug connector 100 and the jack connector 200 enter the state depicted in FIGS. 14, 15, 16 and 17. FIG. 14 is a perspective view of the plug connector 100 and the jack connector 200 in this state. FIGS. 15 through 17 are perspective cross-sectional views of the plug connector 100 and the jack connector 200 in this state, depicting different cross sections. FIG. 15 depicts a cross section corresponding to FIG. 4. FIG. 16 depicts a cross section corresponding to FIG. 5. FIG. 17 depicts a cross section corresponding to FIG. 6.

As a result, the plug terminal 121 of the plug connector 100 contacts the jack terminal 231 in the jack opening 221 of the jack connector 200, and the plug terminal 123 of the plug connector 100 contacts the jack terminal 233 in the jack opening 223 of the jack connector 200. At this point, the edge 111 of the plug connector 100 also enters the groove 211 of the jack connector 200 to contact the slide slopes 253 of the upper projections 251 of the slide 250 of the jack connector 200. In the state depicted in FIGS. 14 through 17, however, the slide slopes 253 of the upper projections 251 are merely in contact with an end of the edge 111 of the plug connector 100, and the slide 250 is not slid in the direction away from the jack terminals 231 through 233. An elastic body such as a spring, which is not depicted, is connected to the slide 250 to maintain the slide 250 in the original state (the position depicted in FIGS. 3 through 7) unless an external force is applied to the slide 250. That is, an elastic body such as a spring exerting a restoring force in a direction to maintain the state of the slide 250 depicted in FIGS. 3 through 6, that is, in a direction to urge the slide 250 toward the jack terminals 231 through 233, is provided in the jack connector 200.

Accordingly, in the state depicted in FIGS. 14 through 17, the plug terminal 121 of the plug connector 100 is in contact with the jack terminal 231 of the jack connector 200, and the plug terminal 123 of the plug connector 100 is in contact with the jack terminal 233 of the jack connector 200. Because the movable contacts 321 and the fixed contacts 311 of the switch part 300 are not in contact, however, the switch part 300 is in OFF state and no electric power is supplied to the plug connector 100. As described above, in this state, the slide slopes 253 of the upper projections 251 of the slide 250 are in contact with the end of the edge 111 of the plug connector 100, and ends of the lower projections 256 of the slide 250 are in contact with the lower flat part 369 of the button 360.

Figure 18:
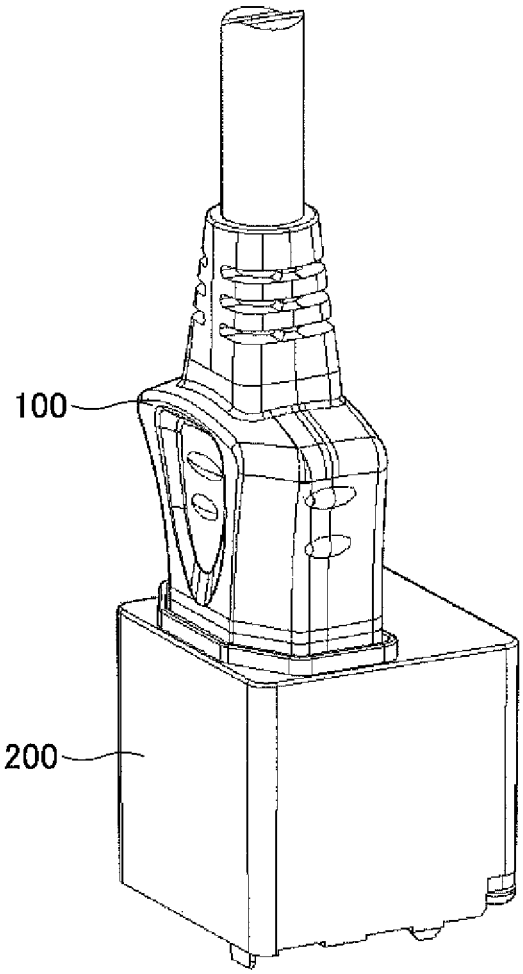
FIG. 18 is a perspective view of the plug connector and the jack connector that are connected.
Figure 19:
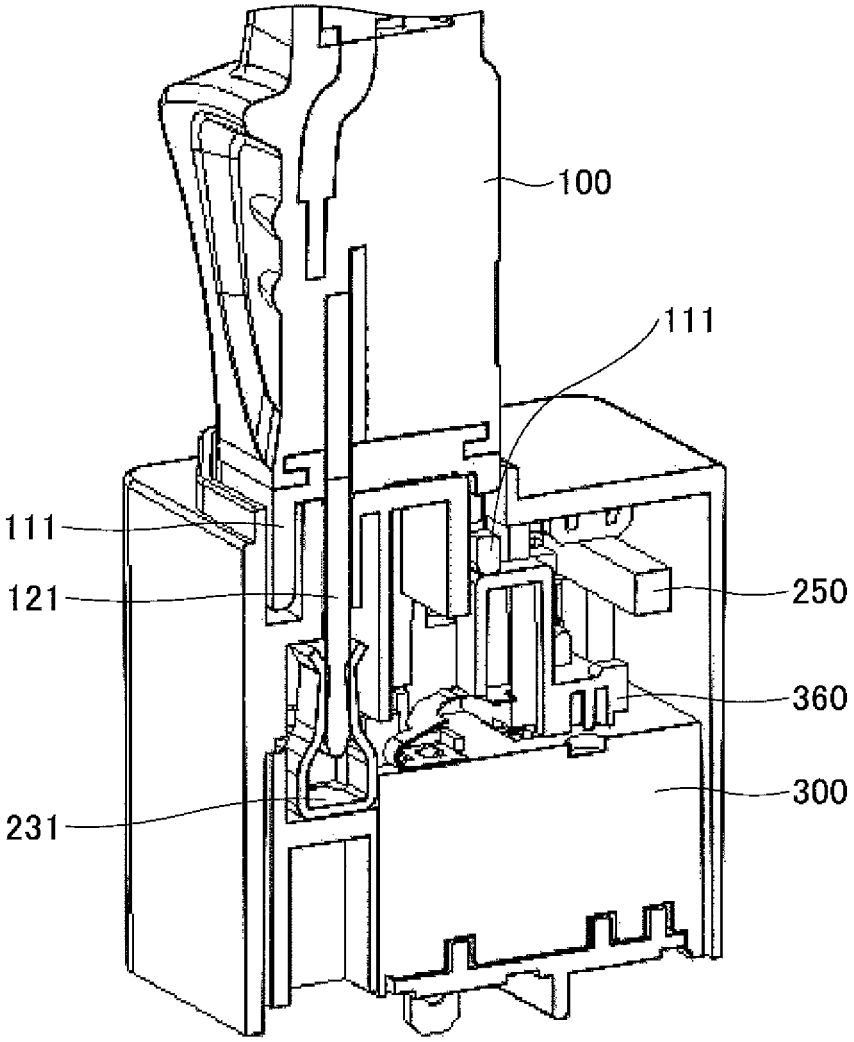
FIG. 19 is a cross-sectional view of the plug connector and the jack connector that are connected.
Figure 20:
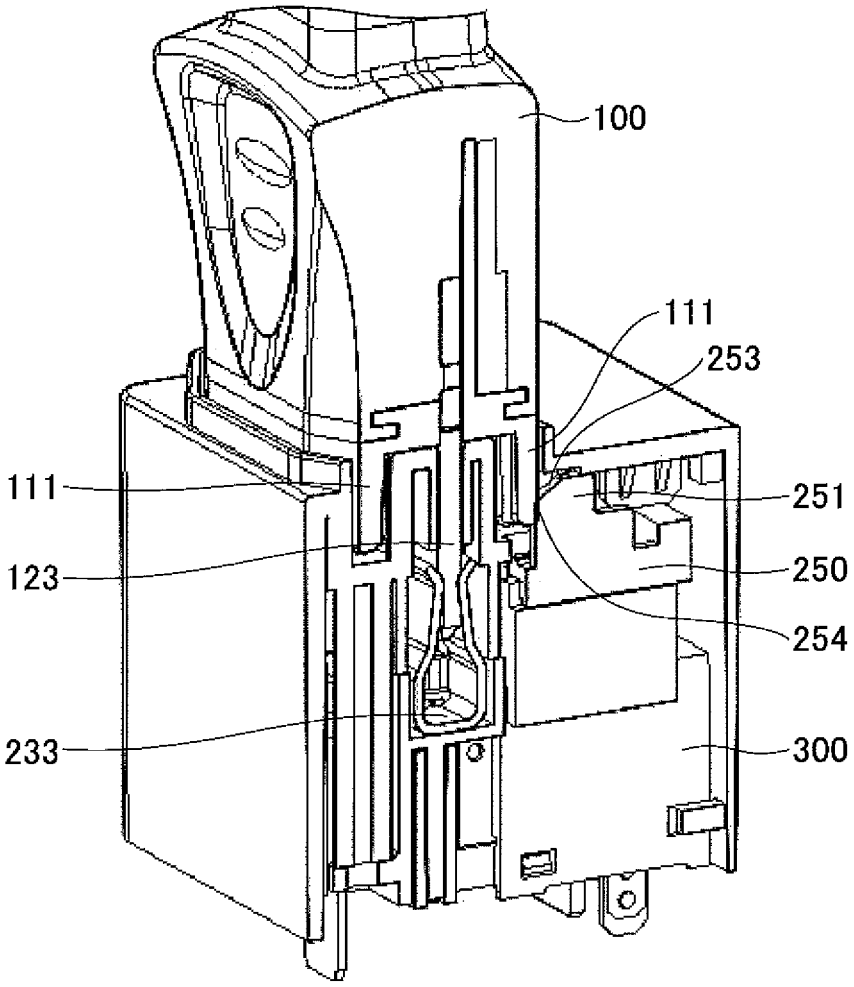
FIG. 20 is another cross-sectional view of the plug connector and the jack connector that are connected.
Figure 21:
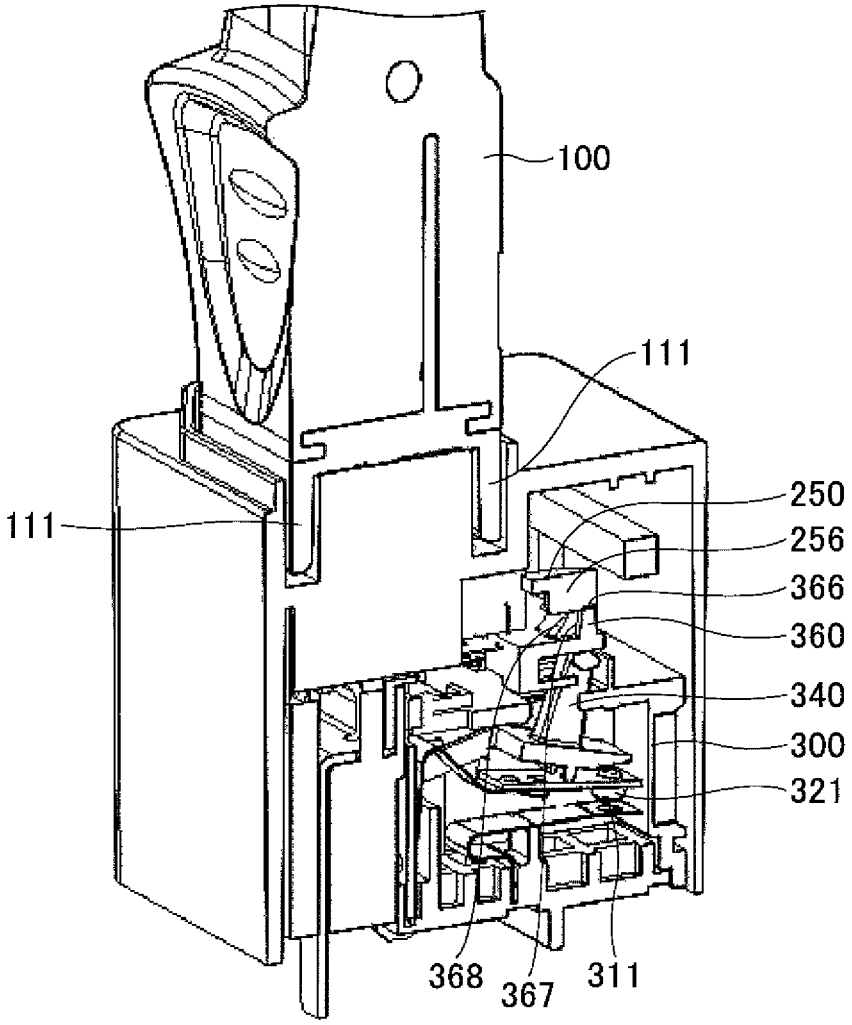
FIG. 21 is yet another cross-sectional view of the plug connector and the jack connector that are connected.

Thereafter, the plug terminals 121 through 123 of the plug connector 100 are inserted further into the jack openings 221 through 223 of the jack connector 200 from the state depicted in FIGS. 14 through 17, and the plug connector 100 and the jack connector 200 enter the state depicted in FIGS. 18, 19, 20 and 21. FIG. 18 is a perspective view of the plug connector 100 and the jack connector 200 in this state. FIGS. 19 through 21 are perspective cross-sectional views of the plug connector 100 and the jack connector 200 in this state, depicting different cross sections. FIG. 19 depicts a cross section corresponding to FIG. 4. FIG. 20 depicts a cross section corresponding to FIG. 5. FIG. 21 depicts a cross section corresponding to FIG. 6.

As a result, the plug terminal 121 of the plug connector 100 goes further into the jack terminal 231 in the jack opening 221 of the jack connector 200 while maintaining the contact with the jack terminal 231. Furthermore, the plug terminal 123 of the plug connector 100 goes further into the jack terminal 233 in the jack opening 223 of the jack connector 200 while maintaining the contact with the jack terminal 233.

At this point, the edge 111 of the plug connector 100 also goes further into the groove 211 of the jack connector 200, and the slide slopes 253 of the upper projections 251 of the slide 250 of the jack connector 200 are pressed by the end of the edge 111 as the plug connector 100 being pushed. The slide slopes 253 are thus pressed by the end of the edge 111, so that the slide 250 slides in the direction away from the jack terminals 231 through 233 until the end of the edge 111 reaches the positions of the slope ends 254 of the slide 250. FIG. 20 depicts the state where the edge 111 has reached the slope ends 254.

As a result, the lower projections 256 or the protrusions 257 of the slide 250 contact the steep slopes 367 of the button 360, and the slide 250 slides in the direction away from the jack terminals 231 through 233. As a result, a downward force is applied to the button 360 by the lower projections 256 or the protrusions 257, so that the lower projections 256 or the protrusions 257 move onto the upper flat parts 366 of the button 360. As a result, the button 360 is pressed to rotate the card 340 to bring the movable contacts 321 and the fixed contacts 311 of the switch part 300 into contact. As the plug terminal 123 of the plug connector 100 is already in contact with the jack terminal 233 of the jack connector 200, electric power is supplied from the jack connector 200 to the plug connector 100 by the contact of the movable contacts 321 and the fixed contacts 311 of the switch part 300.

Figure 22:
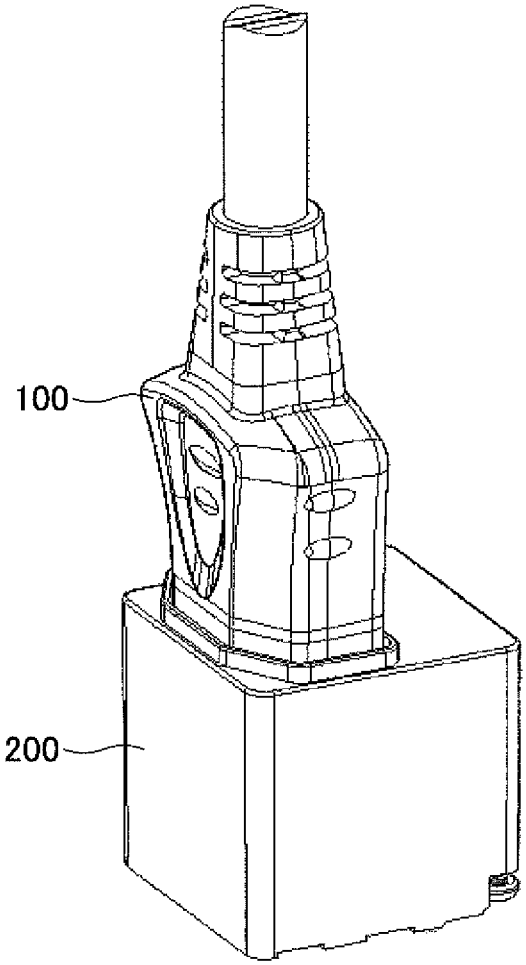
FIG. 22 is a perspective view of the plug connector and the jack connector in the process of being separated.
Figure 23:
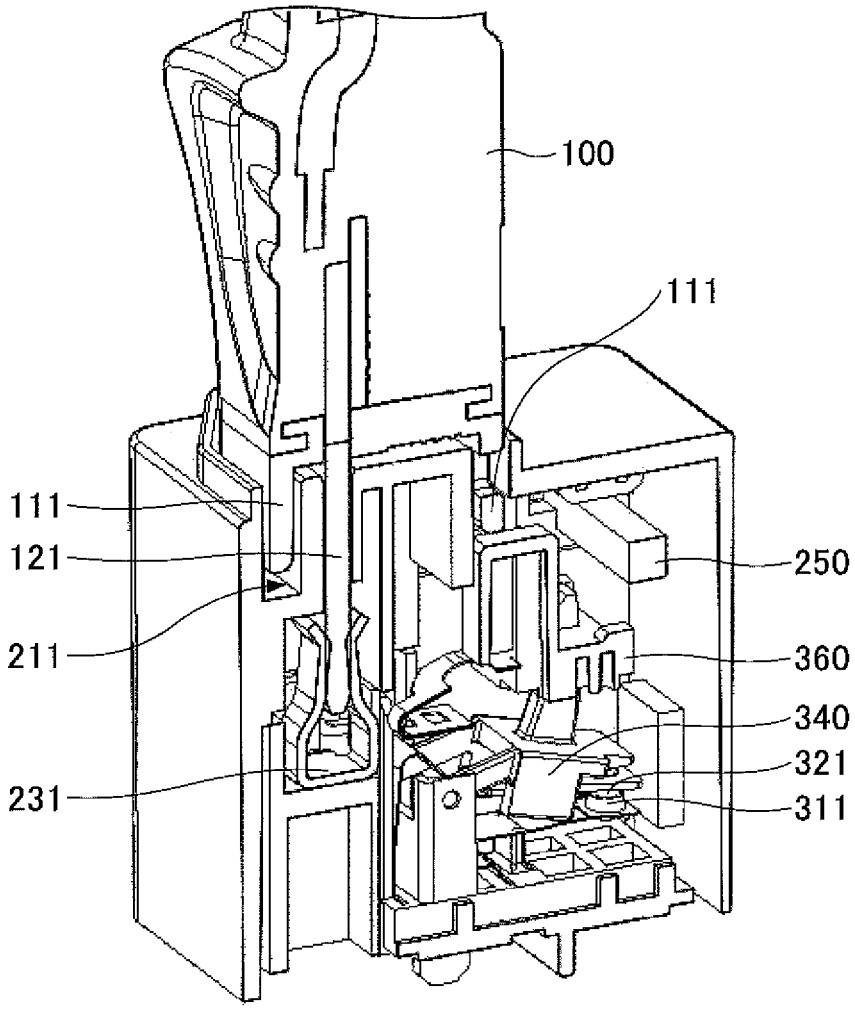
FIG. 23 is a cross-sectional view of the plug connector and the jack connector in the process of being separated.
Figure 24:
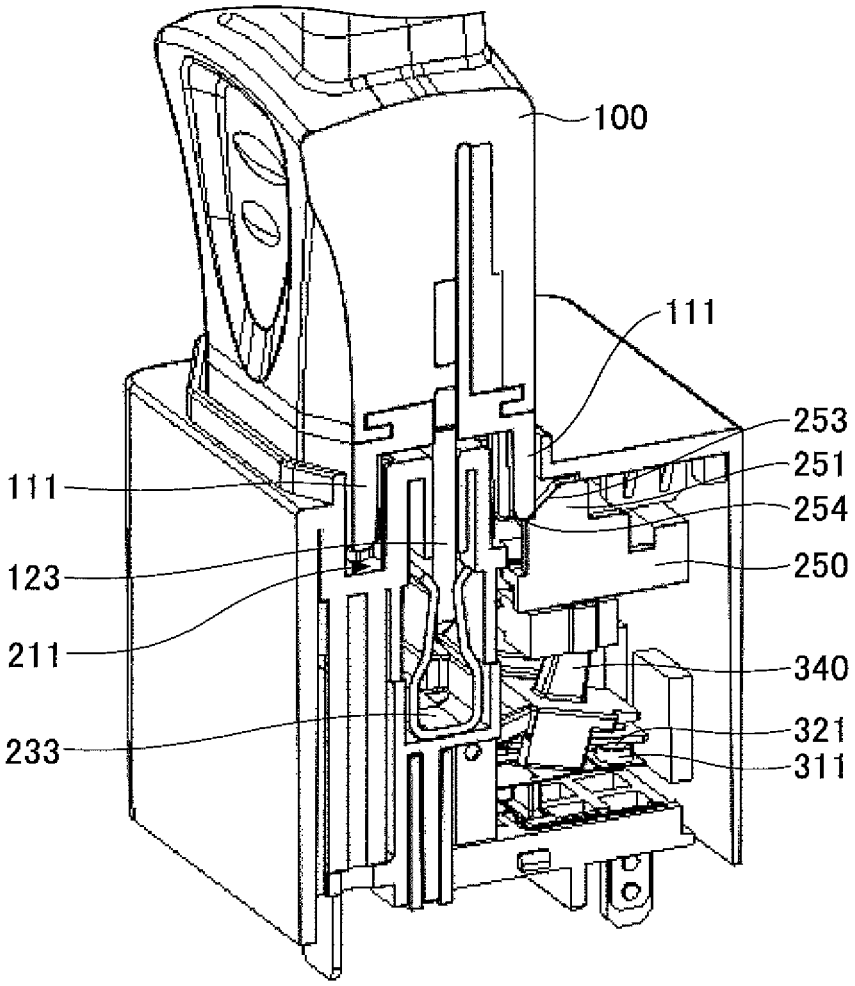
FIG. 24 is another cross-sectional view of the plug connector and the jack connector in the process of being separated.
Figure 25:
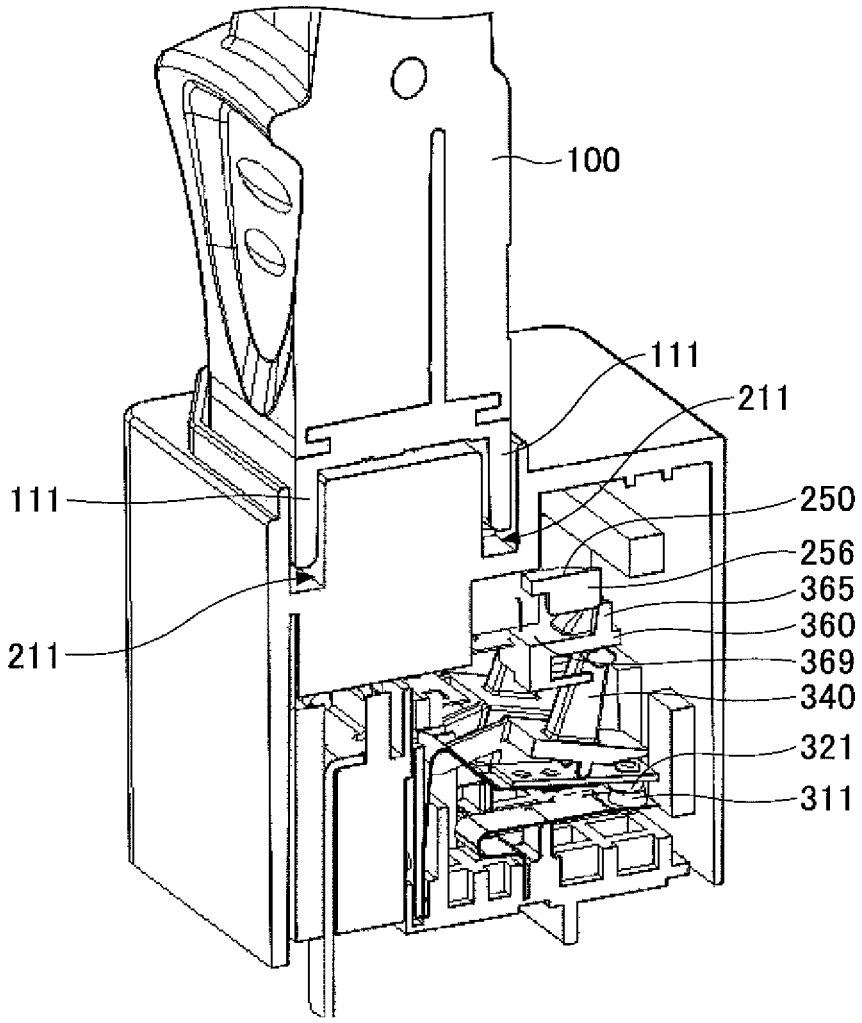
FIG. 25 is yet another cross-sectional view of the plug connector and the jack connector in the process of being separated.

Next, when stopping an electric power supply, that is, removing the plug connector 100 from the jack connector 200, is described. First, the plug connector 100 slightly moves away from the jack connector 200 relative to the state depicted in FIGS. 18 through 21, so that the plug connector 100 and the jack connector 200 enter the state depicted in FIGS. 22, 23, 24 and 25. FIG. 22 is a perspective view of the plug connector 100 and the jack connector 200 in this state. FIGS. 23 through 25 are perspective cross-sectional views of the plug connector 100 and the jack connector 200 in this state, depicting different cross sections. FIG. 23 depicts a cross section corresponding to FIG. 4. FIG. 24 depicts a cross section corresponding to FIG. 5. FIG. 25 depicts a cross section corresponding to FIG. 6.

As a result, the plug connector 100 and the jack connector 200 slightly move away from each other, while the plug terminal 121 of the plug connector 100 and the jack terminal 231 in the jack opening 221 of the jack connector 200 are kept in contact, and the plug terminal 123 of the plug connector 100 and the jack terminal 233 in the jack opening 223 of the jack connector 200 are likewise kept in contact.

In this state, the outside of the end of the edge 111 of the plug connector 100 is in contact with the slope ends 254 of the upper projections 251 of the slide 250 of the jack connector 200. Therefore, the button 360 is pressed, so that the movable contacts 321 and the fixed contacts 311 of the switch part 300 are kept in contact. Accordingly, in this state, electric power is supplied to the plug connector 100 as the plug terminal 121 and the jack terminal 231 are kept in contact and the plug terminal 123 and the jack terminal 233 are kept in contact in the plug connector 100 and the jack connector 200.

Thereafter, the plug connector 100 is further removed from the jack connector 200, and the plug connector 100 and the jack connector 200 enter the state depicted in FIGS. 14 through 17. When the end of the edge 111 is out of contact with the slope ends 254, the slide 250 starts to return and slide toward the jack terminals 231 through 233 by a spring force. The operation described below is based on this operation of the slide 250. At this point, the protrusions 257 of the lower projections 256 of the slide 250 slide on the steep slopes 367 of the button projections 365 of the button 360. As a result, the lower projections 256 of the slide 250 move to the lower flat part 369 of the button 360 so that a force pressing the button 360 is released, and the button 360 moves upward to return to the original position.

As the button 360 thus returning to the original position, the movable contacts 321 and the fixed contacts 311 of the switch part 300 are separated so that the movable contacts 321 and the fixed contacts 311 are out of contact. In this state, the electric power supply to the plug connector 100 is interrupted although the plug terminal 123 of the plug connector 100 and the jack terminal 233 of the jack connector 200 are kept in contact.

Thereafter, the plug connector 100 and the jack connector 200 move further away from each other to be in the state depicted in FIGS. 3 through 6, and the plug terminal 121 and the jack terminal 231 are out of contact and the plug terminal 123 and the jack terminal 233 are out of contact. At this point, the electric power supply to the plug connector 100 is interrupted because the movable contacts 321 and the fixed contacts 311 of the switch part 300 are already separated before the plug terminal 121 and the jack terminal 231 become out of contact and the plug terminal 123 and the jack terminal 233 become out of contact. Accordingly, arcs are not generated when the plug terminal 121 and the jack terminal 231 become out of contact and the plug terminal 123 and the jack terminal 233 become out of contact.

According to this embodiment, the protrusions 257 of the lower projections 256 of the slide 250 move on the steep slopes 367 of the button projections 365 of the button 360. Therefore, when the protrusions 257 and the steep slopes 367 become out of contact, the button 360 instantaneously moves upward to instantaneously interrupt an electric power supply. According to this embodiment, the speed of interruption of an electric power supply or the like can be controlled by changing the slope angle of the steep slopes 367.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. A connector and a connector unit have been described based on one or more embodiments of the present invention. It should be understood, however, that the various changes, substitutions, and alterations could be made hereto without departing from the spirit and scope of the invention.

DESCRIPTION OF THE REFERENCE NUMERALS

100 plug connector, 110 plug housing, 111 edge, 121, 122, 123 plug terminal, 130 power supply cable, 200 jack connector, 210 jack housing, 211 groove, 221, 222, 223 jack opening, 231, 232, 233 jack terminal, 250 slide, 251 upper projection, 252 upper surface, 253 slide slope, 254 slope end, 256 lower projection, 257 protrusion, 300 switch part, 310 fixed part, 311 fixed contact, 312 fixed spring, 320 movable part, 321 movable contact, 322 movable plate, 323 movable spring, 330 base block, 331 base block body, 332 fixed part support, 333 insulation wall, 340 card, 341 upper contact (first contact), 342 lower contact (second contact), 343 rotation shaft, 344 projection, 344*a* contact, 345 card body, 350 switch part case, 351 switch part opening, 352 wall, 360 button, 361 inner wall, 362 end, 365 button projection, 366 upper flat part, 367 steep slope, 368 moderate slope, 369 lower flat part, 370 opening spring, 380 permanent magnet

The invention claimed is:

1. A connector, comprising:

a fixed contact;

a movable contact provided on one end of a movable plate;

a connection terminal to be connected to another connection terminal of another connector, the connection terminal being connected to the fixed contact or the movable contact;

a card provided in contact with the movable plate;

a button provided in contact with the card; and a slide provided in contact with the button, wherein, with the connection terminal being in contact with the another connection terminal, the slide is pressed by the another connector to slide to move the button, and the movable plate is moved by the movement of the button via the card so that the movable contact moves into contact with the fixed contact.

2. The connector as claimed in claim 1, comprising:

a plurality of the fixed contacts; and a plurality of the movable contacts.

3. The connector as claimed in claim 1, wherein the slide includes a slope that contacts the another connector, and wherein the slope is pressed by the another connector.

4. The connector as claimed in claim 1, wherein the slide includes a projection that is in contact with the button, wherein the button includes a slope, and wherein, when the connector and the another connector are separated, the projection moves on the slope.

5. The connector as claimed in claim 1, wherein the slide includes a first slope formed on a first surface of the slide to contact the another connector; and a projection provided on a second surface of the slide opposite to the first surface to be in contact with the button, wherein the first slope is pressed by the another connector so that the slide slides to move the button, and wherein the button includes a second slope, and when the connector and the another connector are separated, the projection moves on the second slope.

6. The connector as claimed in claim 1, wherein the connector is a jack connector and the connection terminal is a jack terminal.

7. A connector unit, comprising:

the connector and the another connector as set forth in claim 1.

8. The connector unit as claimed in claim 7, wherein the connector is a jack connector and the connection terminal is a jack terminal, and wherein the another connector is a plug connector and the another connection terminal is a plug terminal.

* * * * *